US005124615A

United States Patent [19]

Kim

[11] Patent Number: 5,124,615

[45] Date of Patent: Jun. 23, 1992

[54] PLASMA DISPLAY DEVICE

[75] Inventor: Han-jong Kim, Seoul, Rep. of Korea

[73] Assignee: Samsung Electron Devices Co., Ltd., Seoul, Rep. of Korea

[21] Appl. No.: 611,645

[22] Filed: Nov. 13, 1990

[30] Foreign Application Priority Data

Jan. 31, 1990 [KR] Rep. of Korea ..... 90-1215[U]

[51] Int. Cl.[5] ..... H01J 1/62; H01J 63/04; H01J 17/49

[52] U.S. Cl. ..... 313/485; 313/584; 313/586

[58] Field of Search ..... 313/485, 586, 585, 584

[56] References Cited

U.S. PATENT DOCUMENTS 4,185,229 1/1980 Yoshikawa et al. ..... 313/586
4,429,303 1/1984 Aboelfotoh ..... 313/485
4,780,644 10/1988 Sakai et al. ..... 313/485
4,827,186 5/1989 Knaver et al. ..... 313/485
4,843,281 6/1989 Mendelsohn ..... 313/586
4,996,460 2/1991 Kim et al. ..... 313/586
4,999,541 3/1991 Kim et al. ..... 313/585
5,001,393 3/1991 Kim ..... 313/586

*Primary Examiner*—Donald J. Yusko
*Assistant Examiner*—Brian Zimmerman
*Attorney, Agent, or Firm*—Cushman, Darby & Cushman

[57] ABSTRACT

A plasma display panel (PDP) of a planar discharger type which causes an auxiliary discharge and a display discharge in a single cell. The PDP includes anodes and cathodes formed in strips of different orientations and in different planes such that individual cells are formed which have a display anode, a display cathode, and an auxiliary anode.

6 Claims, 2 Drawing Sheets

PLASMA DISPLAY DEVICE

BACKGROUND OF THE INVENTION

1. Field of the Invention

This invention relates to a plasma display device, more particularly, to a plasma display panel (PDP) of a planar discharge type in which an auxiliary discharge and a display discharge occur in a single cell.

2. Description of the Prior Art

Recently, design efforts related to flat-type display devices have progressed from conventional cathode ray tube (CRT) display devices to other display forms. Examples of such display forms include liquid crystal displays (LCDs), electroluminescence displays (ELDs), fluorescent indicator panels (FIPs), and plasma display panels (PDPs).

The PDP has particular advantages; for example, the PDP can be easily produced in large quantities, has more than twice the lifetime of conventional CRT devices, and can be of a large size. These advantages result from the PDP's structure, which is simpler than other flat panel display devices. For example, because it has no fragile parts besides glass, the PDP is easy to mass produce. The PDP is thus well-suited for a flat type display device.

A common problem in conventional DC type pulse memory PDPs is low luminance. FIG. 1 shows a partially broken, perspective view of a conventional DC type pulse memory PDP according to Japanese patent No. sho 57-86886. This PDP comprises a back glass substrate 100 and a front glass substrate 200. Display cathodes 110 and barrier rib 150 are sequentially formed on the back glass substrate 100 by a screen printing technique. Auxiliary anodes 140 and display anodes 130 are formed on the front glass substrate 200, also by the screen printing technique. The barrier rib 150 is disposed between the auxiliary discharge area 170 and the display discharge area 180, and provides an auxiliary discharge path for diffusing electric charge particles.

In this type of PDP, display discharge between the display anode and the display cathode is aided by the auxiliary discharge between the auxiliary anode and the display cathode.

In the operation of such a DC type pulse memory PDP, a memory function causes an ON state to be achieved simultaneously on a plurality of display cells associated with a particular display anode. All of the display cells associated with, for example, display anode 130*a* generate a large discharge current which flows through display anode 130*a*. Thus, such a device requires a display anode capable of conducting a large current. However, a large display anode acts to shield the emission of light generated from a display cell, thus lowering the luminance.

Another problem of conventional DC type pulse memory PDPs is erroneous discharge. Because a discharge start voltage depends on the distance between the display anode and the display cathode, this distance must be uniform in order to obtain a stable memory function; that is, stable discharge without errors. A larger panel size increases the likelihood of deviations in the distance between the display anode and cathode, thus resulting in erroneous discharge or an unstable memory function.

In the PDP of FIG. 1, separation distance between display anode and display cathode is determined by the height of the barrier rib 150. However, the conventional screen printing method used to form the barrier rib frequently results in a rib of nonuniform thickness, thus giving rise to nonuniform display anode-display cathode separation distance.

SUMMARY OF THE INVENTION

It is therefore an object of the present invention to provide for a planar discharge type PDP with a high degree of luminance.

It is a further object of the present invention to provide for a planar discharge type PDP in which erroneous discharge is reduced.

These and other objects of the present invention are achieved by a planar discharge type PDP in which auxiliary discharge and display discharge occur within a single cell. The present invention provides for a PDP which comprises: a back substrate and a front substrate, both of which may be made of glass; display cathodes formed in strips on the back substrate; and a dielectric layer formed on the back substrate in strips of a substantially uniform thickness which intersect the display cathode strips and cover the display cathode strips at the points of intersection. The PDP further comprises: display anodes formed in strips on the dielectric layer strips; auxiliary anodes formed in strips on the front glass substrate; and a lattice-type barrier rib formed on the back substrate which is provided with an electric charge particle path which corresponds with each auxiliary anode. The strip formation of the above elements results in a PDP which includes a plurality of discharge cells each containing portions of each of a display cathode, an auxiliary anode and a display anode.

BRIEF DESCRIPTION OF THE DRAWINGS

A better understanding of the present invention and its advantages will result from studying the following detailed description of a presently preferred embodiment together with the accompanying drawings in which.

DETAILED DESCRIPTION OF A PREFERRED EMBODIMENT

Figure 1:
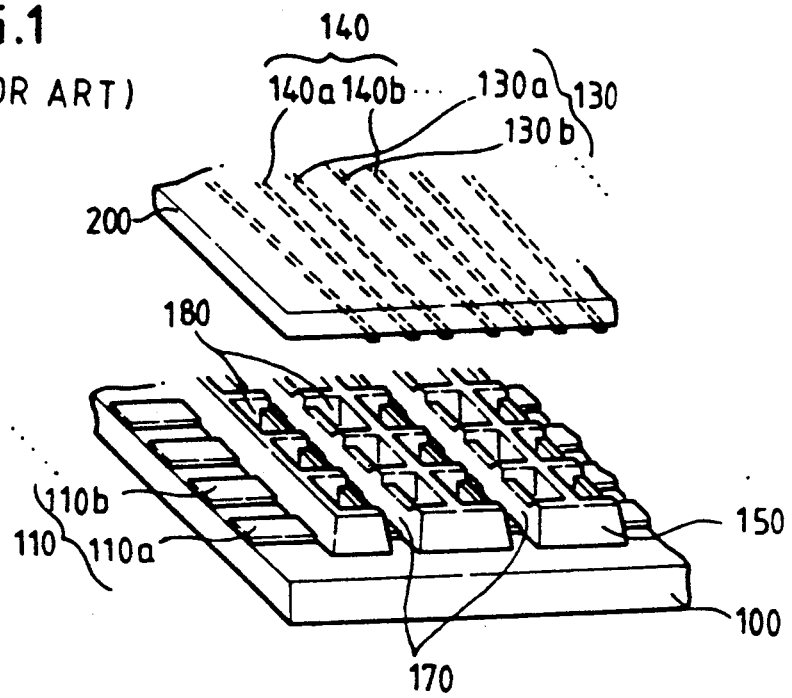
FIG.1 (PRIOR ART)
FIG. 1 is a partially broken, perspective view of a conventional direct current type pulse memory PDP.
Figure 2:
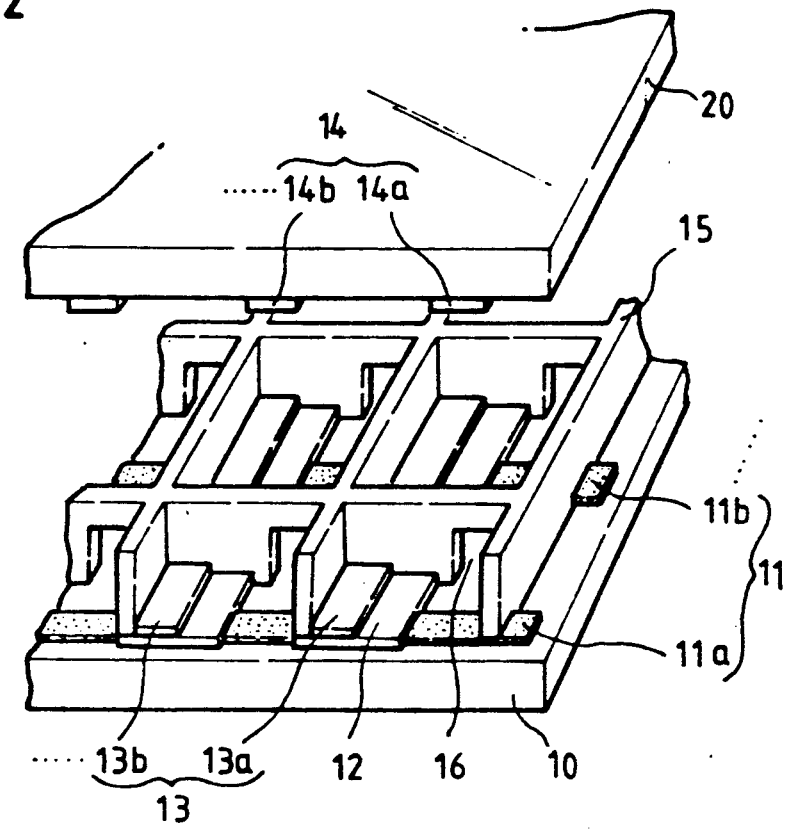
FIG. 2 is a partially broken, perspective view of a planar discharge type PDP according to the present invention.
Figure 3:
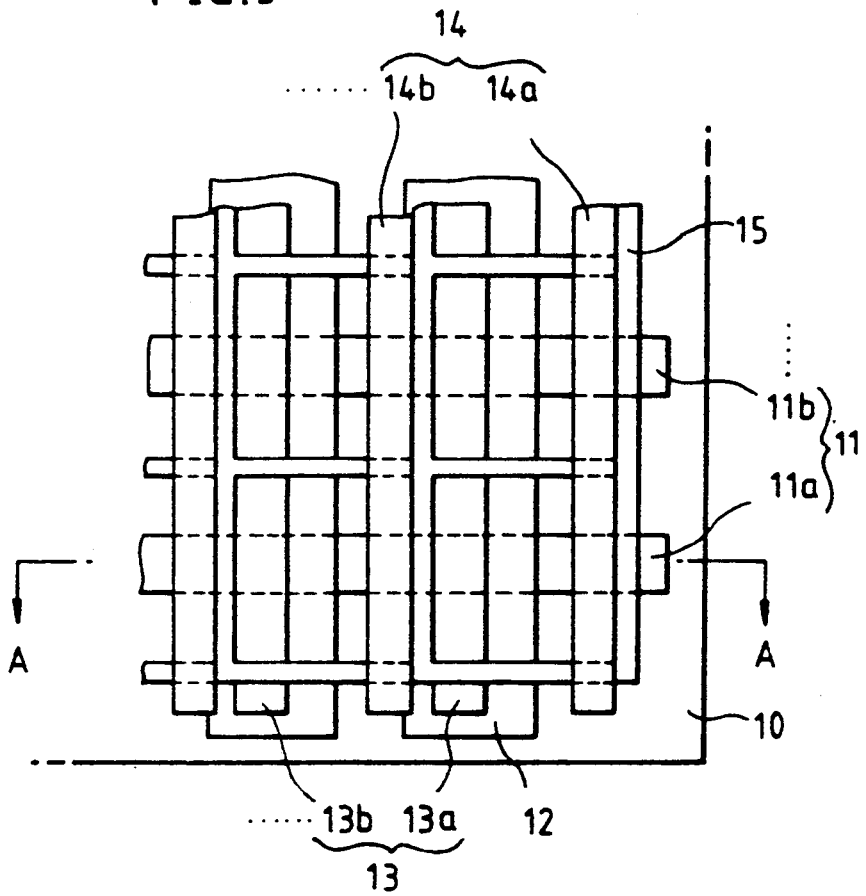
FIG. 3 is a plan view of a planar discharge type PDP according to the present invention.

As shown in FIG. 2 and FIG. 3, the planar discharge type PDP according to the present invention is manufactured by forming display cathodes 11 in strips 11*a*, 11*b*, . . . on a back substrate 10. A dielectric layer 12 is formed on the back substrate 10 in strips which intersect the display cathode strips 11 and which cover the display cathode strips 11 at the points of intersection. Display anodes 13 are formed in strips 13*a*, 13*b*, . .. on the dielectric layer strips 12. The dielectric layer strips 12 are of a substantially uniform thickness. The display anodes thus lie in a plane substantially parallel to that of the display cathodes 11, and are of a different orientation than the display cathode strips 11*a*, 11*b*, . . .

Auxiliary anodes 14 are formed in strips 14*a*, 14*b*, . . . on the inner surface of the front glass substrate 20. The strips 14*a*, 14*b*, . . . are also of a different orientation than the display cathode strips 11*a*, 11*b*, . . .

A lattice type barrier rib 15 is also formed on the back glass substrate 10 and is provided with a path 16 for connecting discharge cells with adjacent discharge cells. The path 16 is parallel with each of the auxiliary anodes 14. The auxiliary anodes 14 are separated from the display anodes 13 and the display cathodes 11 by the barrier rib 15.

The display cathode strips 11*a*, 11*b*, . . . and display anode strips 13*a*, 13*b*, . . . lie in separate, substantially parallel planes, and would intersect but for their separation by the dielectric layer 12. Similarly, the display cathodes 11 and the auxiliary anodes 14 lie in separate planes, and would intersect but for their separation by the lattice type barrier rib 15. The display anodes 13, dielectric layer strips 12, and auxiliary anodes 14 may be of substantially the same orientation, such that they are all substantially parallel to one another. The display cathodes 11, display anodes 13, auxiliary anodes 14, and the lattice type barrier rib 15 are arranged such that individual discharge cells are formed within lattice type barrier rib 15 with each cell including each type of electrode; for example, an individual cell might include portions of display cathode 11*a*, display anode 13*a*, and auxiliary anode 14*a*.

The electrodes comprising a single discharge cell in the interior of lattice type barrier rib 15 cause an auxiliary discharge between display cathode 11*a* and auxiliary anode 14*a*, and a display discharge between display cathode 11*a* and display anode 13*a*, respectively. If a color PDP is desired, a phosphor layer may be provided on the inner surface of the front glass substrate 20. After the back glass substrate 10 and the front glass substrate 20 are formed as described, the substrates are sealingly attached to each other. A vacuum is maintained within the panel, and its circumference is sealed after introducing a discharge gas into the interior of the panel.

Figure 4:
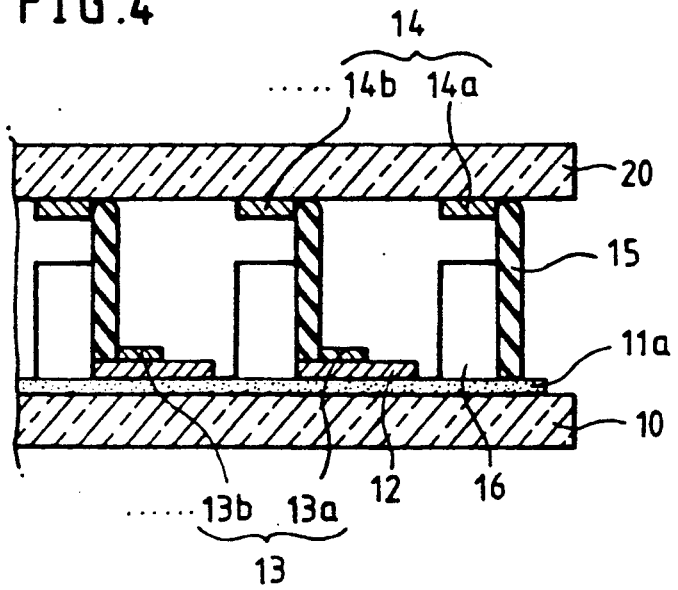
FIG. 4 is a cross-sectional view taken along line A—A of FIG. 3.

The operation of the preferred embodiment of the present invention will now be described with reference to a pulse memory type PDP, as in Japanese patent No. sho 57-86886. Referring now to FIG. 4, when a voltage pulse is supplied between the display cathode 11*a* and the auxiliary anode 14*a*, an electric charge particle is produced and a weak discharge occurs in a designated pixel. This electric charge particle sequentially moves to the adjacent discharge area through the path 16 of the lattice type barrier rib 15.

If data is written (that is, if a voltage is applied) along the display anode 13*a*, a display discharge is quickly generated in a designated pixel due the effect of precharging. Thus, time required for discharge becomes shorter, and the rate of voltage pulses can be increased, thereby achieving increased luminance. Further, because the display anodes and the display cathodes are separated only by the thickness of the dielectric layer, the likelihood of a variation of display anode-display cathode distance is reduced, thereby reducing the possibility of erroneous discharge. A further advantage of the present invention is that, because the auxiliary anode is disposed so that auxiliary and display discharges are generated within a single cell, pitch between conventional cells created by an auxiliary anode separated by a conventional barrier rib is reduced.

While the invention has been described in connection with a presently preferred embodiment, the foregoing description should not be construed as limiting the scope of the invention, but as merely providing an illustration thereof. Numerous modifications will be readily apparent to one skilled in the art. Accordingly, it is the Applicant's intention to define the scope of the invention by the appended claims and their legal equivalents.

What is claimed is:

1. A plasma display panel, comprising:

a back substrate;

a front substrate;

display cathodes formed in strips on said back substrate;

a dielectric layer formed in strips on said back substrate; said dielectric layer strips intersecting said display cathode strips and covering said display cathode strips at the points of intersection;

display anodes formed in strips on said dielectric layer strips;

auxiliary anodes formed in strips on said front substrate, said auxiliary anode strips being of a different orientation than said display cathode strips; and a lattice type barrier rib formed on said back substrate and defining a plurality of discharge cells, said barrier rib having openings therein defining an electric charge particle path extending parallel to said auxiliary anode strips, said path also extending from cell-to-cell within said rib to thereby facilitate movement of electric charge particles from cell-to-cell within said rib, said front substrate being sealingly attached to said back substrate and said barrier rib to complete the formation of said discharge cells, each of said discharge cells containing portions of one of said display cathodes, one of said display anodes, and one of said auxiliary anodes.

2. The plasma display panel of claim 1, wherein said front and back substrates are made of glass.

3. The plasma display panel of claim 2, wherein a phosphor layer is provided on said front glass substrate.

4. The plasma display panel of claim 1, wherein said display anode strips are of substantially the same orientation as said dielectric layer strips.

5. The plasma display panel of claim 4, wherein said auxiliary anode strips are of substantially the same orientation as said display anode strips and said dielectric layer strips.

6. The plasma display panel of claim 1, wherein said dielectric layer strips are of a substantially uniform thickness.

* * * * *